US007631943B2

(12) United States Patent
Romagnoli et al.

(10) Patent No.: US 7,631,943 B2
(45) Date of Patent: Dec. 15, 2009

(54) FEEDING BRISTLES TO BRUSH-MAKING MACHINE

(75) Inventors: Marino Romagnoli, Bologna (IT); Raffaele Nadalini, Bologna (IT)

(73) Assignee: Unimac S.R.L, Zola Predosa (Bologna) (IT)

( * ) Notice: Subject to any disclaimer, the term of this patent is extended or adjusted under 35 U.S.C. 154(b) by 738 days.

(21) Appl. No.: 11/108,017

(22) Filed: Apr. 14, 2005

(65) Prior Publication Data

US 2005/0242655 A1 Nov. 3, 2005

(30) Foreign Application Priority Data

Apr. 20, 2004 (IT) ..... BO2004A0225

(51) Int. Cl.
*A46D 3/08* (2006.01)

(52) U.S. Cl. ..... 300/21; 300/4

(58) Field of Classification Search ..... 300/2, 300/4–7, 21

See application file for complete search history.

(56) References Cited

U.S. PATENT DOCUMENTS 6,578,928 B1 * 6/2003 Romagnoli et al. ..... 300/2

6,726,789 B1 * 4/2004 Weihrauch ..... 156/72

FOREIGN PATENT DOCUMENTS

JP 04-226609 * 8/1992

* cited by examiner

*Primary Examiner*—Laura C Guidotti
(74) *Attorney, Agent, or Firm*—Andrew Wilford

(57) ABSTRACT

Bristles are fed to a brush-making machine by an apparatus having a drum centered on and extending along a drum axis and formed with a plurality of angularly spaced and axially extending passages each of a circularly segmental cross section with a vertex directed radially inward toward the axis and each having a downstream end and an opposite upstream end. A respective group of elongated flexible bristles is supplied through the upstream ends into each of the passages and expelled from the downstream ends. A nozzle immediately downstream of the downstream ends has an outlet aperture of a predetermined inside diameter and a frustoconical inner surface tapering downstream away from the downstream ends and axially aligned with the downstream passage ends such that at least some of the bristles exiting the downstream end of each passage engage and are deflected by the inner surface.

21 Claims, 5 Drawing Sheets

444a-2a
444b-2b
444c-2c
6-7
5
4

422a
422b 10
9
8
7
5
4
6
20 20a
10
2a
1
C
443
444a
T
440
441
442a
C
B
B
430
424a
423
A
A
420
421
422a
410

FEEDING BRISTLES TO BRUSH-MAKING MACHINE

FIELD OF THE INVENTION

The present invention relates to a system for feeding bristles in a circular arrangement, particularly for use in automatic machines for forming circular brushes.

More particularly, the present invention relates to a system of the aforesaid type, particularly for use in an automatic machine of the type described and illustrated in Italian Patent 1,309,972 (corresponding to European Patent 1,044,628 and U.S. Pat. No. 6,578,928).

BACKGROUND OF THE INVENTION

At the present time—see for example the cited patents—the known system for feeding a plurality of bristles in a circular arrangement in order to insert them between a nut and a ring, has a mechanical assembly including:

a plurality of telescopic tubes each having a circular cross section, positioned at equal circumferential intervals;

clamp means upstream of the group of telescopic tubes for gripping the bundles of continuous bristles arriving from reels; and cutting means downstream of the telescopic tubes for cutting, downstream of the tubes, the bristles of the bundles positioned in the tubes and for forming a circular exit aperture for the bristles being fed.

With this system, in order to feed the bristles in a circular array, the bristles are gripped in the proximity of the clamp means and the clamp means are then shifted toward the cutting means.

Also with this system, when it is necessary to change the diameter of the circular arrangement of the bristles being fed toward the nut and ring, for example if there is a change in the internal diameter of the ring and/or in the outside diameter of the corresponding nut, then, in order to form a circular brush having a different configuration, it is necessary to replace the aforesaid mechanical assembly, comprising telescopic tubes, clamp means and cutting means, in order to fit a different mechanical assembly, in which the telescopic tubes are positioned at equal circumferential intervals around a circumference having a lesser or greater diameter, with corresponding clamp means and cutting means.

Clearly, therefore, the operations for changing the configuration are labor-intensive and complicated.

OBJECT OF THE INVENTION

The object of the present invention is to overcome the aforesaid drawbacks.

SUMMARY OF THE INVENTION

The invention resolves the problem of creating a system for feeding a plurality of bristles in a circular arrangement, particularly for use in automatic machines for forming circular brushes, the system being characterized in that it comprises:

a drum extending axially along its own axis and designed to form a plurality of axial passages each having a cross section in the form of a sector of a circle, in a circular arrangement with the corresponding vertices orientated toward the central axis of the drum; and a replaceable nozzle positioned downstream of the passages with respect to the direction of feeding of the bristles and designed to form an internal truncated conical cavity tapered from the upstream to the downstream end and having an outlet aperture; in which, in order to change the maximum diameter of the circular arrangement of the bristles being fed, the nozzle is replaced with one having an outlet aperture with a different diameter.

By using a system of the aforesaid type, it is possible to carry out a change of configuration with respect to the diameter of the circular arrangement of the bristles being fed, and a change of configuration with respect to the number of bristles, in an easy and rapid way, thus reducing the operating time.

BRIEF DESCRIPTION OF THE DRAWINGS

Further characteristics and advantages of the present invention will be made clearer by the following detailed description of preferred embodiments, provided purely by way of example and without restrictive intent, with reference to the figures of the attached drawings, in which.

SPECIFIC DESCRIPTION

With reference to the following description, the system according to the present invention is particularly suitable for application to circular brush-making machines of the type described and illustrated in Italian Patent 1,309,972 (i.e. EP 1,044,628 and/or U.S. Pat. No. 6,578,928), the contents of which are expressly referred to in relation to the present invention.

Figures 1, 1A, 1B:
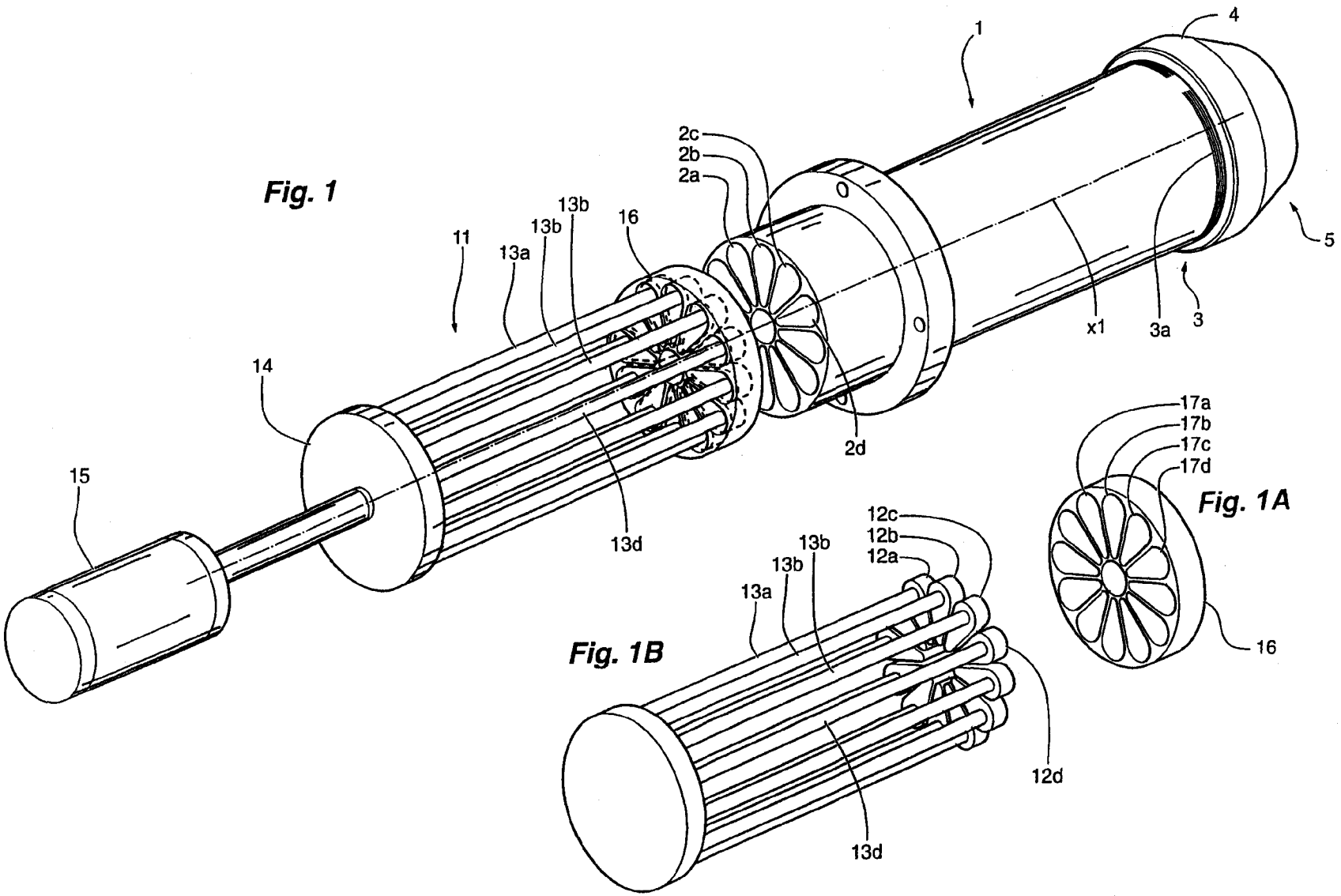
FIG. 1 is a schematic perspective view of a first embodiment of the present invention.
FIG. 1A is a detail of FIG. 1.
FIG. 1B is another detail of FIG. 1.
Figure 2:
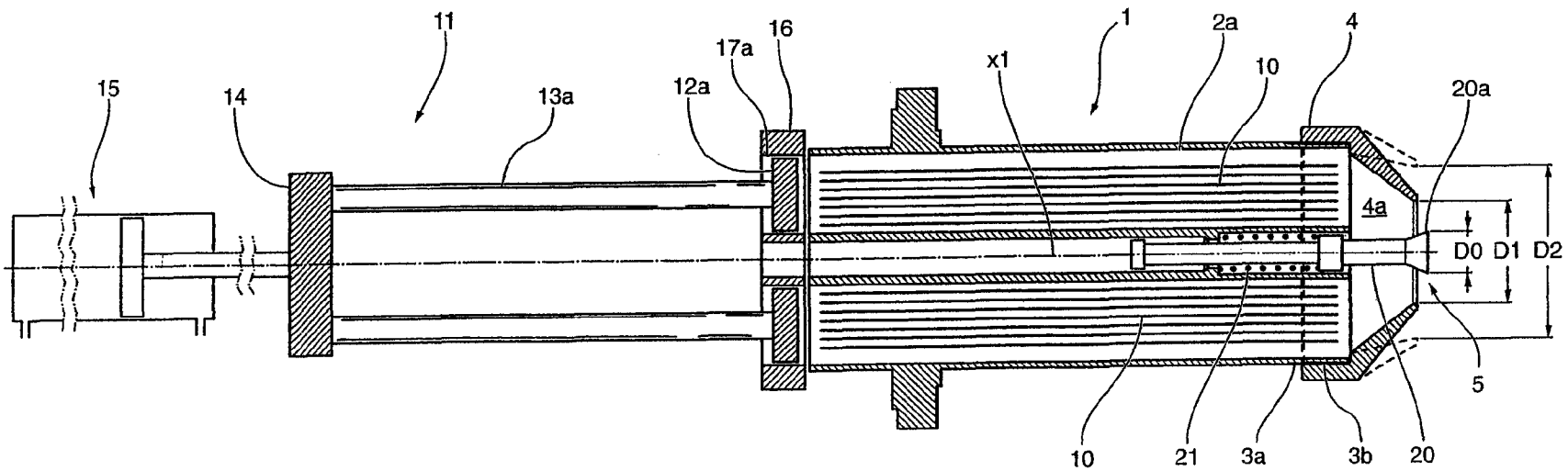
FIG. 2 is a schematic view of the embodiment of FIG. 1 in section along a longitudinal median plane.

With reference to FIGS. 1 and 2, the system for feeding a plurality of bristles comprises a drum 1 including a plurality of passages 2*a*, 2*b*, 2*c*, 2*d*, etc., positioned at equal circumferential intervals and extending longitudinally, each having a cross section in the form of a sector of a circle, with the corresponding vertices orientated toward the central longitudinal axis X1 of the circumferential arrangement of the passages 2*a*, 2*b*, 2*c*, etc.

In the proximity of the downstream end of the drum 1 there are positioned engagement and release means 3, designed to be replaceable and to fix in position a nozzle 4, which has a truncated conical internal cavity 4*a* tapering from the upstream to the downstream end and (see FIG. 2) having a maximum diameter upstream substantially equal to the maximum diameter formed by the passages 2*a*, 2*b*, 2*c*, etc., and, at its downstream end, a circular outlet aperture 5, having a diameter chosen to match the size of the configuration of the brush to be formed, as explained more fully below. Preferably, the engagement and release means 3 have, for example, an external thread 3*a* near the downstream end of the drum 1 and designed to engage with an internal thread 3*b* formed in an upstream portion of the nozzle 4.

In the proximity of the central axis X1 of the drum 1 (see FIG. 2) there is optionally positioned a cylindrical shaft 20, which is preferably axially retractable into the drum 1 and is elastically axially outward into an extended position by a spring 21.

Figure 3:
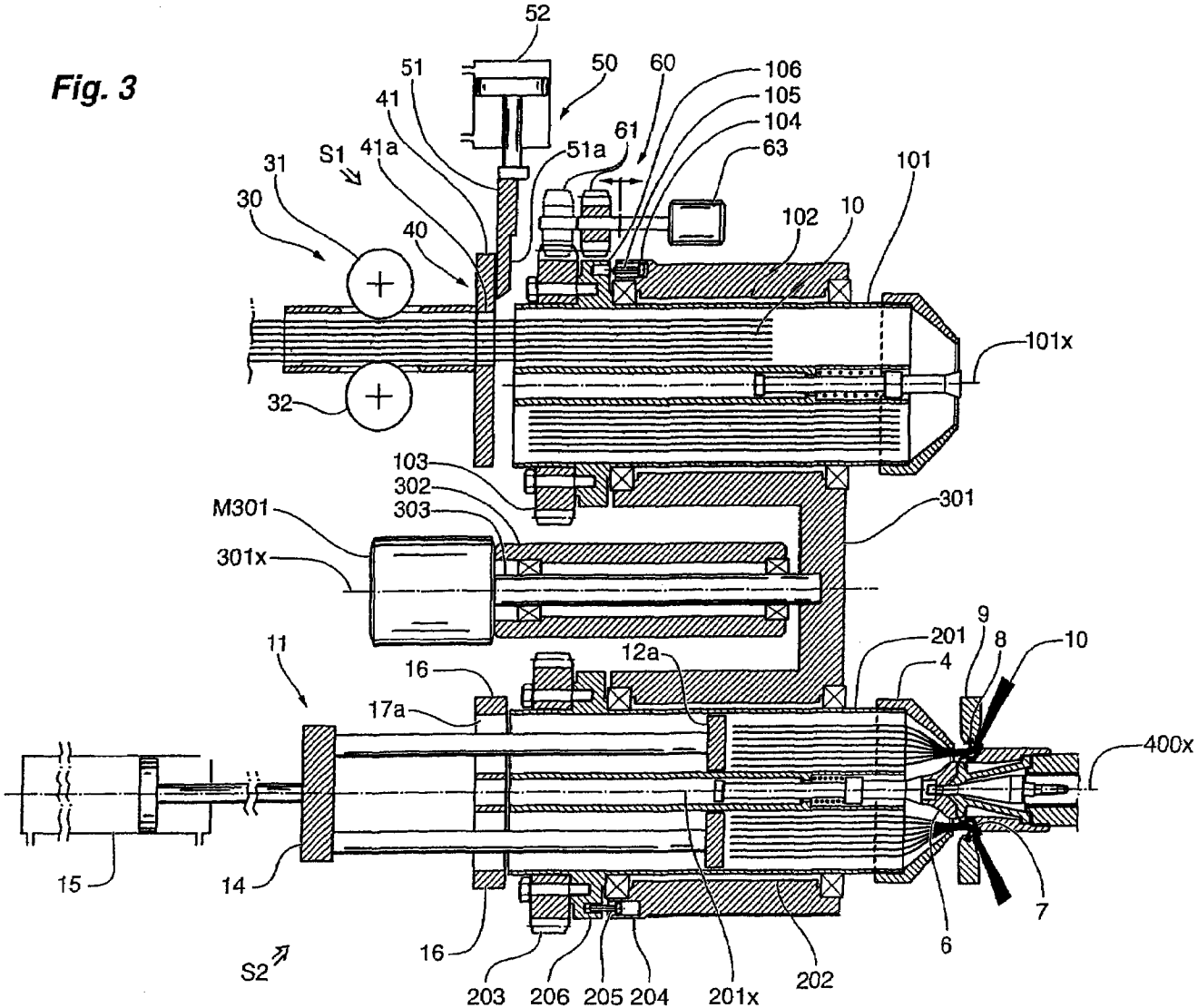
FIG. 3 shows the system of the preceding figures applied in an automatic machine for forming circular brushes.
Figure 4:
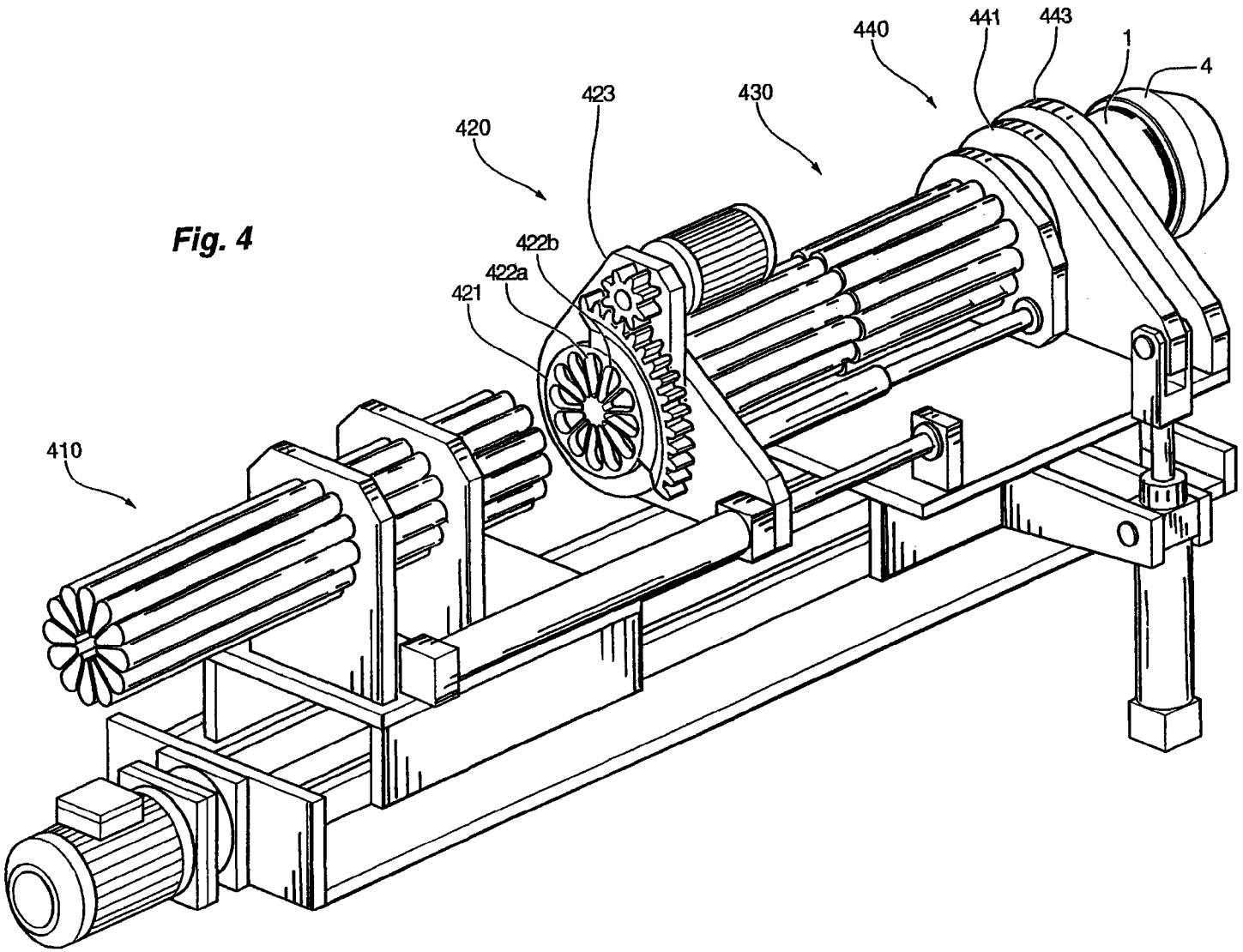
FIG. 4 shows another embodiment of the system according to the present invention.
Figures 5, 5A, 5B, 5C:
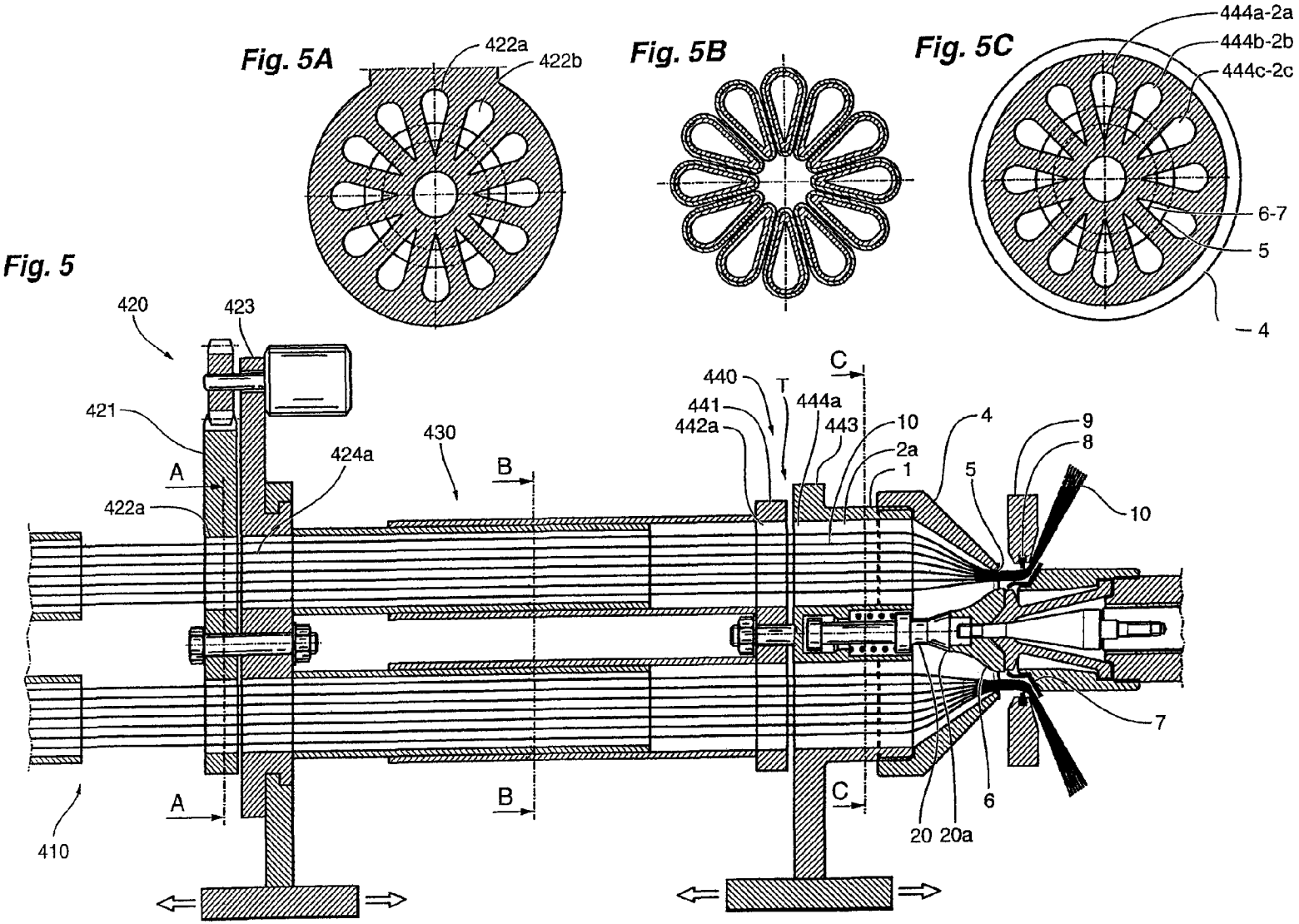
FIG. 5 shows the system of FIG. 4 in section along a vertical longitudinal plane of FIG. 4.
FIGS. 5A, 5B and 5C show, respectively, sectional views along the lines A-A, B-B and C-C of FIG. 5.

Clearly, therefore—see in particular FIG. 3 (and FIGS. 5 and 5C for the other embodiment) owing to the particular shape mentioned above, each of the aforesaid passages 2*a*, 2*b*, 2*c*, etc. can contain, without the replacement of parts, either a large or a small number of bristles 10, and furthermore the bristles 10, advancing in a downstream direction, that is to say toward the outlet aperture 5 of the nozzle 4 and toward the downstream portion of the central shaft 20 and/or toward a mandrel 6 and nut 7, will all be fed downstream in the form of a circular ring and will be inserted correctly between the mandrel 6 and nut 7 and a ring 8 supported by positioning means 9, where the mandrel 6 and nut 7 and the positioning means 9 and ring 8 are present in a circular brush-making machine, such as a machine described in the previously cited Italian Patent 1,309,972.

With reference to the particular mode of feeding the bristles in the form of a circular ring (see FIG. 2), the maximum diameter of the ring is determined by the diameter of the outlet aperture 5 of the nozzle 4, namely D1, and the minimum diameter of the ring is determined by the diameter of the downstream end of the shaft 20, namely D0.

In the particular operating configuration shown in FIG. 3, the minimum diameter is determined by the diameter of the mandrel 6 and nut 7 positioned centrally, preferably within the outlet aperture 5, and against the downstream end of the shaft 20.

With reference to the central shaft 20 (see FIG. 2), it is also optionally possible to provide, if necessary, a downstream end which can support a replaceable cone 20*a*, positioned preferably tapering upstream, so that the profile and/or the diameter D0 of the downstream-end portion of the shaft 20 can be modified by replacing the cone 20*a*, with respect to the profile of the mandrel 6 and nut 7, to improve the sliding and insertion flow of the bristles 10.

Similarly, the mandrel and nut assembly 6-7 is also replaceable, making it possible to change the minimum diameter of the circular ring configuration of the bristles being fed and/or the diameter of the nut 7.

Thus, with reference to what has been stated above, regardless of the means used to advance the bristles 10 downstream, as explained more fully below, it is possible, by using the system described above comprising the drum 1 and nozzle 4, to rapidly change the maximum diameter of the circular ring arrangement of the bristles 10 being fed, and thus to change the configuration rapidly, simply by replacing the nozzle 4, for example (see FIG. 2) by replacing a first nozzle 4, having an outlet aperture 5 with a diameter D1, with a second nozzle having an outlet aperture with a diameter D2, the latter being shown in broken lines.

Additionally, if it is also desired to change the minimum diameter of the aforesaid circular ring feed of the bristles 10, it is sufficient to make a simple and rapid replacement of the mandrel 6 and nut 7 and/or the cone 20*a*, if the latter is optionally present and if necessary.

Description of a First Embodiment

With reference to a first preferable embodiment and application of the aforesaid system (see FIG. 3), in order to longitudinally advance segments of bristles 10 lying within the passages 2*a*, 2*b*, 2*c*, etc., in order to feed them in a circular ring arrangement and insert them between the nut 7 and the ring 8, the system can comprise expulsion members indicated as a whole by 11, comprising a plurality of pistons 12*a*, 12*b*, 12*c*, 12*d*, etc. each having a cross section in the form of a sector of a circle, that is to say a shape such that the pistons mate with and slide longitudinally inside respective ones of the passages 2*a*, 2*b*, 2*c*, 2*d*, etc. of the drum 1, the pistons 12*a*, 12*b*, 12*c*, 12*d*, etc. being positioned at the downstream ends of corresponding rods 13*a*, 13*b*, 13*c*, 13*d*, etc. (see FIG. 1B), whose opposite ends are fixed to a disc 14, which in turn is moved longitudinally by means of a fluid-actuated piston 15.

In this embodiment, it is also optionally preferable to provide a guide element 16, comprising a plurality of aligning and centering passages 17*a*, 17*b*, 17*c*, etc. (FIG. 1A), designed to contain and support the pistons in the correct configuration before their active stroke which expels the bristles, as explained more fully below. With this arrangement, therefore, it is possible to implement a specific operating system comprising the following stages of operation:

a) loading segments of bundles of bristles 10 into one or more circumferential passages 2*a*, 2*b*, etc. of the drum 1;
b) inserting the pistons 12*a*, 12*b*, etc. into the upstream ends of the circumferential passages 2*a*, 2*b*, etc. of the drum 1;
c) advancing the pistons 12*a*, 12*b*, etc. along the passages 2*a*, 2*b*, etc. and toward the downstream end of the drum 1 to provide a corresponding advance of the segments of bundles of bristles 10 toward and beyond the outlet aperture 5 of the nozzle 4.

With reference to FIG. 3, in this first application of the aforesaid system, there is provided a rotating frame 301, supported rotatably by a fixed tube 302 supported by the machine frame (not shown), in which the rotating frame 301 is rotated about its longitudinal axis 301*x*, for example by means of a hydraulic motor M301 which drives a shaft 303, where the axis of rotation 301*x* is positioned parallel to and above an axis 400*x* which forms the operating axis of the circular brush-making machine.

The frame 301 is designed to support, in opposition to each other, two drums 101 and 201, substantially identical to the drum 1 described above (similar numbers are therefore used in the numbering), which are supported rotatably about their longitudinal axes 101*x* and 201*x* by means of corresponding cylindrical housings 102 and 202, for example, the drums 101 and 101 being rotatable with the respective axes of rotation 101*x* and 201*x* positioned parallel to the axes 301*x* and 400*x*.

The drums 101 and 201 are also associated with corresponding stopping and positioning means 104 and 204, carried by the rotating frame 301 and designed to prevent or allow the rotation of the corresponding drums 101 and 201 about their axes 101*x* and 201*x*, and also, optionally, designed to establish, for each drum 101 and 201, one or more rotational positions, in which the passages 2*a*, 2*b*, 2*c*, etc. are correctly aligned axially with respect to operating means located in two operating stations as described more fully below.

The stopping and positioning means 104 and 204 can be of various types, for example mechanical and/or electromechanical and/or optoelectromechanical types, consisting for example of an electromechanical clutch 105 and 205 designed to interact with a disc 106 and 206 which has axial seats and/or stops spaced at equal circumferential intervals, to establish a plurality of desired angular positions for the drums 101 and 201.

With this arrangement, therefore, the two drums 101 and 201 can be translated along a circular path, and, for reasons which are given below, each drum 101 or 201 can be stopped in a first loading station S1, for loading segments of bristles into one or more of the passages 2*a*, 2*b*, etc., or in a second expulsion station S2, for feeding the bristles 10 in a circular arrangement, the central axis of rotation 101$x$ or 201$x$ of the corresponding drum 101 or 201 being aligned with the axis 400$x$ of the circular brush-making machine.

It should be borne in mind that the mandrel 6 carrying the nut 7 is movable longitudinally on command, and therefore, when it is moved to the right with respect to FIG. 3, it does not impede the entry of the drum 101 or 201 into the second station S2.

The first station S1 for loading the bristles is positioned in an upper area, opposite the second station S2 for bristle insertion, in such a way that when a drum 201 is halted in the second station S2 the opposite drum 101 is halted in the first station S1.

The loading station S1 substantially comprises devices for forming and loading segments of bristles 10 into one or more of the passages 2$a$, 2$b$, etc. of the halted drum 101, and more specifically, it substantially comprises the following, from the upstream to the downstream end:

a first unit 30 for continuous bristle feeding, designed to drive one or more bundles of bristles downstream, comprising for example a pair of driving means with contra-rotating knurled rollers 31 and 32 between which one or more bundles of bristles 10 obtained from the reels are driven and advanced;

a second unit 40 for guiding the bristles, designed to guide the bundles of bristles into one or more passages 2$a$ of the drum 101 or 201 and to act as a counter-blade, comprising an element 41 supported by the machine frame and having one or more guide passages 41$a$ positioned facing and aligned with one or more passages 2$a$, etc. of the drum 101 or 201, by means of the aforesaid stopping and positioning means 104 and 204 that set the correct angular position for the drums 101 and 201;

a third unit 50 for cutting, designed to cut, on command, the bundles of bristles 10 after their insertion into one or more passages 2$a$, etc., comprising, for example, a blade 51 driven by a fluid-actuated cylinder 52, where the blade 51 is provided with a profile 51$a$ such that the insertion of the segments of cut bristle into the passages 2$a$, 2$b$, etc. is facilitated; and a fourth unit 60 for rotating the drum, designed to rotate, on command, with calibrated angular movements, the drum 101 or 102 positioned and halted in the station S1 during the stages of loading the bristle segments 10, comprising, for example, a device supported at its top by the machine frame, comprising a gear wheel 61, movable axially on command, which can engage on command with a ring gear 103 or 203, positioned on the shell of the drum 201 or 101, the wheel 61 being driven by a servo motor 63.

With this arrangement, therefore, it is possible to load the passages 2$a$, 2$b$, 2$c$, etc. with segments of bristle 10 in a selective way as desired, for example by carrying out alternate loading, in other words loading the passages 2$a$, 2$c$, etc. and keeping the passages 2$b$, 2$d$, etc. empty, or by loading all the passages 2$a$, 2$b$, etc.

The second station S2 for expelling the bristles substantially comprises the guide element 16, the pistons 12$a$, 12$b$, etc., and the fluid dynamic cylinder 15, all of which have been described above.

With this arrangement, when a drum 101 or 201, previously loaded with segments of bristles 10, as described above, arrives at the station S2 and stops there at the side of the guide element 16, it has a rotational position which is fixed and set by the stopping and positioning means 104 and 204, so as to provide a correct longitudinal alignment between the aligning and centering passages 17$a$, 17$b$, 17$c$, etc., and the passages 2$a$, 2$b$, 2$c$, 2$d$, etc. of the drum 101 or 201, and therefore, after the mandrel 6 and nut 7 have been brought toward and up to the downstream end 20$a$ of the central shaft 20, the fluid dynamic cylinder 15 is operated, causing the pistons 12$a$, 12$b$, 12$c$, etc. to advance downstream into the passages 2$a$, 2$b$, 2$c$, 2$d$, etc., thus feeding the bristles 10 in a circular ring arrangement.

With reference to what has been mentioned above, the operating means mentioned above are associated with each other and controlled by electronic means, such as a PLC and/or a personal computer or other device.

Again with reference to the embodiment described above, it is clear that, in the same way as described above, it is possible to provide three or more drums, supported by an equivalent rotating element 301, and, additionally, two or more stations S1 for loading the bundles of bristles.

Description of a Second Embodiment

With reference to FIGS. 4, 5, 5A, 5B and 5B, these illustrate a variant embodiment of the system according to the present invention applied in a circular brush-making machine of the type described and illustrated in the previously cited U.S. Pat. No. 6,578,928.

In this second embodiment, the following are provided, in a way substantially similar to that described in the patents cited above:

twelve bristle insertion tubes 410;

a bristle clamp unit 420 comprising a first jaw 421 provided with axial holes 422$a$, 422$b$, etc. and a second jaw 423 provided with identical corresponding axial holes 424$a$, etc.;

a group of twelve telescopic tubes 430; and a cutting unit 440 comprising a first rotating blade 441 provided with axial holes 442$a$, 442$b$, etc. having cutting downstream ends and a second fixed counter-blade 443, provided with identical corresponding axial holes 444$a$, etc. having cutting upstream ends, the axial holes 422$a$, etc., 424$a$, etc., 442$a$, etc., 444$a$, etc., the tubes 410, and the telescopic tubes 430 preferably having cross sections in the form of sectors of circles.

In this embodiment, the system comprising the drum 1 and nozzle 4 according to the present invention, described above with reference to FIGS. 1, 2 and 3, is positioned downstream of the cutting unit 440, downstream of the blade 443 and made in one piece with it, and, more specifically, has the drum 1 provided with axial passages 2$a$, 2$b$, 2$c$, etc. having cross sections in the form of sectors of circles and corresponding in this case to the axial holes 444$a$, 444$b$, etc. of the counter-blade 443, the nozzle 4 provided with an outlet aperture 5, and the central shaft 20 that is optionally retractable and is optionally provided with the replaceable cone 20$a$.

With this arrangement, after a circular brush has been completed by the cutting of the bristles at the point T between the rotating blades 441 and 443 of the cutting unit 440, a new ring 8 is positioned by the means 9, a new nut 7 is positioned on the mandrel 6, and the mandrel 6 and nut 7 are brought up to the downstream end 20$a$ of the central shaft 20.

When this operating configuration has been established, the bristles 10 are gripped by the bristle clamp unit 420, and the bristle clamp unit 420 is then moved toward the fixed bristle cutting unit 440, in which the axial holes 442$a$, etc. of the rotating blade 441 are correctly aligned with corresponding passages 444$a$-2$a$, etc. of the cutter 443 and drum 1, to cause a downstream advance of the free ends of the bristles 10, which, as stated above, are thus fed between the ring 8 and the mandrel 6 and nut 7 in a circular ring arrangement, with a maximum diameter defined by the diameter of the aperture 5 and a minimum diameter defined by the diameter of the downstream end 20$a$ of the free shaft 20 and/or by the diameter of the mandrel 6 and nut 7.

Thus the considerations stated above in respect of the execution of a change of configuration are applicable to this embodiment also.

The above description of the system has been given purely by way of example and without restrictive intent, and clearly, therefore, any modifications and/or variations suggested by practical experience can be made in respect of its use or application, within the scope of the following claims, which also constitute an integral part of the above description.

The invention claimed is:

1. An apparatus for feeding bristles to a brush-making machine, the apparatus comprising:

a drum centered on and extending along a drum axis and formed with a plurality of angularly spaced and axially extending passages each of a circularly sectoral cross section with a vertex directed radially inward toward the axis and each having a downstream end and an opposite upstream end;

supply means for advancing a respective group of elongated flexible bristles through the upstream ends into each of the passages;

means for expelling the groups of bristles from the downstream ends of the respective passages; and a nozzle immediately downstream of the downstream ends and having an outlet aperture of a predetermined inside diameter and a frustoconical inner surface tapering downstream away from the downstream ends and axially aligned with the downstream passage ends such that at least some of the bristles exiting the downstream end of each passage engage and are deflected by the inner surface, the nozzle being replaceable with another such nozzle having an outlet apertures of different size for formation of bristle arrays of different diameters.

2. The bristle-feeding apparatus defined in claim 1, further comprising:

a shaft having a head positioned immediately downstream of the drum on the axis, whereby the shaft head defines a minimum inside of the bristle array being formed.

3. The bristle-feeding apparatus defined in claim 2 wherein the shaft is retractable axially upstream into the drum, the apparatus further comprising;

a mandrel centered on the axis immediately downstream of the downstream ends; and an annular nut spacedly surrounding the mandrel.

4. The bristle-feeding apparatus defined in claim 3 wherein the mandrel and nut are in the outlet aperture.

5. The bristle-feeding apparatus defined in claim 2 wherein the head of the shaft carries a removable centering cone.

6. The bristle-feeding apparatus defined in claim 1, further comprising interengageable formations on the nozzle and the drum permitting the nozzle to be secured to and released from the drum.

7. The bristle-feeding apparatus defined in claim 6 wherein the formations are interengaging screwthreads on an upstream portion of the nozzle and on a downstream end of the drum.

8. The bristle-feeding apparatus defined in claim 1 wherein the expelling means includes respective pistons shiftable axially through the passages and actuator means for moving the pistons axially through the passages.

9. The bristle-feeding apparatus defined in claim 1 wherein there are two such drums with parallel axes, the apparatus further comprising a frame carrying both drums and rotatable about a frame axis parallel to the drum axes for displacing the drums through a loading station and, angularly offset therefrom, a feeding station, the nozzle being provided in the feeding station.

10. The bristle-feeding apparatus defined in claim 9, wherein the supply means includes a supply upstream of the loading station of a group of continuous bristles;

cutting means in the loading station for cutting segments from the continuous bristles;

means for rotating the drum in the loading station about the respective drum axis for alignment of each of the passages with the supply and cutting means; and means for advancing the group of continuous bristles into the passage aligned with the supply and cutting means.

11. The bristle-feeding apparatus defined in claim 10 wherein the expelling means includes respective pistons shiftable axially through the passages and actuator means for moving the pistons axially through the passages.

12. The bristle-feeding apparatus defined in claim 10 wherein the expelling means further includes an axially shiftable disk carried by the actuator means; and respective axially extending rods each having an upstream end fixed to the disk and a downstream end carrying a respective one of the pistons.

13. The bristle-feeding apparatus defined in claim 12 wherein the expelling means further includes:

a guide fixed in the loading station between the disk and the pistons and formed with an annular array of guide holes slidably receiving the rods.

14. The bristle-feeding apparatus defined in claim 1, further comprising a bristle-clamp unit having a plurality of telescoping tubes aligned with the passages.

15. A method of operating an apparatus, the apparatus having:

a drum centered on and extending along a drum axis and formed with a plurality of angularly spaced and axially extending passages each of a circularly sectoral cross section with a vertex directed radially inward toward the axis and each having an axially open downstream end and an opposite upstream end; and a nozzle immediately downstream of the downstream ends and having an outlet aperture of a predetermined inside diameter and a frustoconical inner surface tapering downstream away from the downstream ends and axially aligned with the downstream passage ends, the method comprising the steps of sequentially:

a) loading a bundle of bristle segments into each of the passages through the upstream end thereof;

b) inserting respective pistons into the upstream ends of the passages;

c) pushing the pistons axially through the passages and thereby forcing the respective bundles of bristle segments out the downstream ends of the respective passages; and d) radially inwardly deflecting the bristle segments exiting the downstream ends and causing same to bunch and pass through the aperture of the nozzle.

16. The method defined in claim 15 wherein there is a loading station and a feeding station spaced radially from the loading station, the drum being positioned in the loading station for step a) and in the feeding station for steps b), c), and d).

17. The method defined in claim 16 wherein there are two such drums, the method further comprising the step of shifting the drums alternately between the stations.

18. The method defined in claim 17 wherein while step a) is being carried out on one of the drums in the loading station, steps b), c), and d) are carried out with the other of the drums in the feeding station.

19. The method defined in claim 17 wherein the two drums are carried on a common frame rotatable about a frame axis parallel to the drum axis and the axes of the drums are parallel, the frame being rotated about the frame axis to move the drums between the stations.

20. The method defined in claim 19, further comprising the step of rotating the drums about their axes while in at least one of the stations.

21. The method defined in claim 19, further comprising the step of arresting the drums in the stations while respective steps a), b), c), and d) are being carried out.

* * * * *